US006302929B1

(12) United States Patent
Gunnerman

(10) Patent No.: US 6,302,929 B1
(45) Date of Patent: Oct. 16, 2001

(54) AQUEOUS FUEL FOR INTERNAL COMBUSTION ENGINE AND METHOD OF PREPARING

(76) Inventor: Rudolf W. Gunnerman, 210 Gentry Way, Reno, NV (US) 89502

( * ) Notice: Subject to any disclaimer, the term of this patent is extended or adjusted under 35 U.S.C. 154(b) by 0 days.

(21) Appl. No.: 08/222,477

(22) Filed: Apr. 4, 1994

(51) Int. Cl.[7] ..... C10L 1/32
(52) U.S. Cl. ..... 44/302; 44/320
(58) Field of Search ..... 44/301, 302, 320

(56) References Cited

U.S. PATENT DOCUMENTS

| | | | |
|---|---|---|---|
| 1,379,077 | 5/1921 | Blumenberg . | |
| 1,926,071 | 9/1933 | Vance . | |
| 2,006,676 | 7/1935 | Garrett | 204/5 |
| 2,460,700 | 2/1949 | Lyons . | |
| 2,656,830 | 10/1953 | Houdry . | |

(List continued on next page.)

FOREIGN PATENT DOCUMENTS

| | | |
|---|---|---|
| 0025298 | 3/1981 | (EP) . |
| 0072676 | 2/1983 | (EP) . |
| 0095823 | 12/1983 | (EP) . |
| 372353 | 6/1990 | (EP) . |
| 0475620 | 3/1992 | (EP) . |
| 2421940 | 11/1979 | (FR) . |
| 205582 | 10/1923 | (GB) . |
| 669037 | 3/1952 | (GB) . |
| 2019405 | 10/1979 | (GB) . |
| 5269908 | 6/1977 | (JP) . |
| 54000234 * | 1/1979 | (JP) . |
| 5410308 | 1/1979 | (JP) . |
| 5611965 | 2/1981 | (JP) . |
| 57145181 | 9/1982 | (JP) . |
| 01149737 | 6/1989 | (JP) . |
| 01252697 | 10/1989 | (JP) . |
| WO812024 | 7/1981 | (WO) . |
| WO8804311 | 6/1988 | (WO) . |
| WO8910951 | 11/1989 | (WO) . |

OTHER PUBLICATIONS

Smith E. J et al. XPCL Corp. SAE Int. Congr. Pap N. 830385 SAE Spec. Publ. N. SP–5423742 "The Use of Surfactants in Preventing Phase Separation of Alcohol Petroleum Fuel Mixtures".*

F.A. Cotton, et al., *Advanced Inorganic Chemistry*, 4th edition, pp. 215–228.

E.B. Millard, *Physical Chemistry For Colleges*, 1941, pp. 340–344.

M. Venugopalan and R.A. Jones, *Chemistry of Dissociated Water Vapor and Related Systems*, 1968, p. 187.

Gunnerman Motor Corporation, "Ultra Low Emission Internal Combustion Engine Powered Vehicles" (four pages).

*Daily Times*, Salisbury, Maryland, "Environmental Decade's Answer to Henry Ford," 1990, p. 18.

*Oil Market Listener*, Jan. 22, 1993, "Further Tests Lend Credence to Significant Potential of Water–Gasoline Fuel" pp. 1–5.

*Primary Examiner*—Margaret Medley
*Assistant Examiner*—Cephia D. Toomer
(74) *Attorney, Agent, or Firm*—Townsend and Townsend and Crew LLP

(57) ABSTRACT

An aqueous fuel having at least two phases for an internal combustion engine with 20–80 vol. % water, carbonaceous fuel, 2 to less than 20 vol. % alcohol, about 0.3 to 1 vol. % of a nonionic emulsifier, and which may contain up to about 0.1 vol. % of a fuel lubricity enhancer, and up to about 0.03 vol. % of an additive to resist phase separation at elevated temperatures. The fuel has an external water phase and is substantially nonflammable outside the engine. Also disclosed is a method of producing the fuel which includes mixing the carbonaceous fuel and emulsifier together prior to mixing with water and the other components.

6 Claims, 3 Drawing Sheets

U.S. PATENT DOCUMENTS

| | | | | |
|---|---|---|---|---|
| 2,671,311 | | 3/1954 | Rohrbach . | |
| 2,724,698 | | 11/1955 | Kittleson | 252/49.6 |
| 2,920,948 | * | 1/1960 | Weeks | 52/5 |
| 3,037,056 | | 5/1962 | Lowe et al. | 260/561 |
| 3,208,441 | | 9/1965 | Ottofy . | |
| 3,233,986 | * | 2/1966 | Morehouse | 44/320 |
| 3,490,237 | | 1/1970 | Lissant | 60/217 |
| 3,556,976 | | 1/1971 | Ishibashi | 204/327 |
| 3,606,868 | | 9/1971 | Voogd | 123/25 R |
| 3,749,318 | | 7/1973 | Cottell . | |
| 4,011,843 | | 3/1977 | Feuerman | 123/119 |
| 4,048,963 | | 9/1977 | Cottell . | |
| 4,084,940 | | 4/1978 | Lissant . | |
| 4,088,450 | | 5/1978 | Kosaka et al. . | |
| 4,110,973 | | 9/1978 | Haeflich et al. . | |
| 4,133,847 | | 1/1979 | Feuerman | 261/18 |
| 4,158,551 | | 6/1979 | Feuerman . | |
| 4,170,200 | | 10/1979 | Takeuchi et al. . | |
| 4,185,593 | | 1/1980 | McClure . | |
| 4,202,670 | | 5/1980 | Tateishi | 44/51 |
| 4,227,817 | | 10/1980 | Gerry . | |
| 4,230,072 | | 10/1980 | Noguchi et al. . | |
| 4,242,076 | | 12/1980 | Rawyler-Ehrat . | |
| 4,244,328 | | 1/1981 | Lindstrom . | |
| 4,246,082 | | 1/1981 | Feuerman | 204/136 |
| 4,266,943 | | 5/1981 | Lo . | |
| 4,276,131 | | 6/1981 | Feuerman | 204/129 |
| 4,295,859 | | 10/1981 | Boehmke | 44/51 |
| 4,297,107 | | 10/1981 | Boehmke . | |
| 4,333,739 | | 6/1982 | Neves . | |
| 4,369,043 | | 1/1983 | Han . | |
| 4,382,802 | | 5/1983 | Beinke et al. . | |
| 4,385,593 | | 5/1983 | Brooks . | |
| 4,388,892 | | 6/1983 | Rody et al. | 122/4 |
| 4,392,865 | | 7/1983 | Grosse et al. . | |
| 4,418,654 | | 12/1983 | Keiun . | |
| 4,476,817 | | 10/1984 | Lindberg . | |
| 4,477,258 | | 10/1984 | Lepain . | |
| 4,563,982 | | 1/1986 | Pischinger et al. . | |
| 4,565,548 | | 1/1986 | Davis et al. . | |
| 4,594,991 | | 6/1986 | Harvey . | |
| 4,597,671 | | 7/1986 | Marelli . | |
| 4,732,576 | | 3/1988 | Friedrick et al. | 44/51 |
| 4,744,796 | * | 5/1988 | Hazbun | 44/302 |
| 4,793,826 | | 12/1988 | Hayes et al. . | |
| 4,818,251 | | 4/1989 | Easton et al. | 44/72 |
| 4,831,971 | | 5/1989 | Ott et al. . | |
| 4,842,616 | | 6/1989 | Verhille . | |
| 4,907,368 | | 3/1990 | Mullay et al. . | |
| 4,923,483 | | 5/1990 | Layrisse et al. . | |
| 4,925,385 | | 5/1990 | McCord, Jr. . | |
| 4,976,745 | | 12/1990 | Rodriguez et al. . | |
| 4,978,365 | | 12/1990 | Gregoli et al. . | |
| 5,156,114 | * | 10/1992 | Gunnerman | 123/1 A |
| 5,156,652 | | 10/1992 | Gregoli et al. . | |
| 5,284,492 | * | 2/1994 | Dubin | 44/301 |
| 5,308,610 | * | 5/1994 | Bowman | 424/76.5 |
| 5,344,306 | | 9/1994 | Brown et al. | 431/4 |

* cited by examiner

Cylinder Pressure vs. Volume
BMEP = 411 kPa, 1690 rpm

Pressure vs. Crank Angle
BMEP = 445 kPa, 953 rpm

Cumulative Heat Release
BMEP = 456 kPa, 954 rpm
DIESEL
D55 FUEL
Cumulative Heat Release, %
100
90
80
70
60
50
40
30
20
10
-30
-20
-10
0
10
20
30
40
50
60
70
80
90
100
110
120
Crank Angle, deg

AQUEOUS FUEL FOR INTERNAL COMBUSTION ENGINE AND METHOD OF PREPARING

FIELD OF THE INVENTION

This invention relates to a novel aqueous fuel for an internal combustion engine and to a method of preparing same. More particularly, the invention relates to an aqueous fuel combustible in the combustion chamber(s) of internal combustion engines such as are used in motor vehicles, and, still more particularly, the invention relates to aqueous fuels which may be combusted in an internal combustion engine in which the combustion chamber(s) includes a hydrogen-producing catalyst such as is disclosed in Gunnerman U.S. Pat. No. 5,156,114 dated Oct. 20, 1992, the entire disclosure of which is hereby incorporated herein by reference.

BACKGROUND OF THE INVENTION

As indicated in U.S. Pat. No. 5,156,114, there is a need for fuels to replace diesel fuel and gasoline for use in internal combustion engines, especially engines used in motor vehicles. Internal combustion engines, such as engines operating on gasoline and diesel fuel, produce unacceptably high amounts of pollutants which are injurious to human health and may damage the earth's atmosphere. The adverse effects of such pollutants upon health and the atmosphere have been the subject of great public discussion. Undesirable pollutants result from combustion of carbonaceous fuel with combustion air that contains nitrogen. The combustion of conventional fuels with air in conventional engines and the relatively incomplete combustion of such fuels are the primary reasons for unsatisfactory levels of pollutants emitted by vehicles with internal combustion engines.

SUMMARY OF THE INVENTION

A novel aqueous fuel and method of producing same has been discovered which, in addition to reducing pollutants produced by internal combustion engines, including spark ignited and compression engines, is also stable, storable and substantially nonflammable outside the internal combustion engine. The novel fuel comprises a fluid emulsion with at least two-phases comprising 20 to 80 vol. % water and carbonaceous fuel, preferably 40 to 60% carbonaceous fuel, and more preferably carbonaceous fuel selected from the group consisting of gasoline, "straight run gasoline," kerosene fuels, diesel fuels, gaseous carbon-containing fuels, and mixtures thereof, about 2 to less than 20 vol. % alcohol, preferably 2 to about 10%, and about 0.3 to 1 vol. % of a nonionic emulsifier, preferably about 0.5 to about 0.7%. As known in the art, "straight run gasoline" also known as "straight run atmospheric naptha", is the product of the first petroleum fractionation in the production of conventional gasoline products. The carbonaceous fuel may also comprise carbon bearing synthetic products as well as biomass derived oils, in addition to carbon bearing fossil fuels. The emulsion comprises a standard oil/water ("o/w") emulsion with water being the external continuous phase. A third phase may be formed with the alcohol component. Advantageously, a fuel lubricity enhancer and/or an additive to improve resistance to phase separation upon heating may also be included. Preferred lubricity enhancers include silicon-containing compounds which also serve as anti-foam and/or anti-rust agents.

The preparation of the novel fuel is very critical. It is prepared by first mixing the carbonaceous fuel and emulsifier together, providing a mixture of alcohol and water by separately adding alcohol, e.g., ethanol, methanol, etc. to water and adding the water-and-alcohol mixture to the previously prepared fuel-and-emulsifier mixture to produce a mixture of carbonaceous fuel with 20 to 80 vol % water and about 0.3 to 1 vol % emulsifier. Alternatively, water and alcohol may be separately added to the previously formed mixture of carbonaceous fuel and emulsifiers. The resultant mixture is vigorously agitated with sufficient agitation to produce a stable, storable fuel. Where the fuel is to include a fuel lubricity enhancer and/or an additive to resist phase separation at elevated temperatures, such agents are added to the mixture of combustion fuel, emulsifier, alcohol and water prior to the vigorous mixing step. Preferred fuel formulations are made with gasoline or diesel fuel. The gasoline and diesel versions are referred to herein as "A-55" and "D-55" respectively, and as naptha and water. The A-55 and D-55 comprise, respectively, nominally about 51 vol. % water, about 48.5% gasoline and about 0.5% emulsifier; and about 47 vol. % water, about 52.5% diesel and about 0.5% emulsifier. Another preferred fuel formulation may be made with straight run gasoline. The naptha and water fuel comprises, nominally, water and about 40% naptha. Preferably, deionized water is used and, most preferably, charcoal-filtered deionized water. Carbonaceous fuel is present in amounts of about 20% to about 80%, preferably about 40% to about 60% by volume.

The term "internal combustion engine" as used herein is intended to refer to and encompass any engine in which carbonaceous fuel is combusted with oxygen in one or more combustion chambers of the engine. Presently known such engines include piston displacement engines, rotary engines and turbine (jet) engines, including electric spark ignited and compression, e.g., diesel engines.

DETAILED DESCRIPTION

Figure 1:
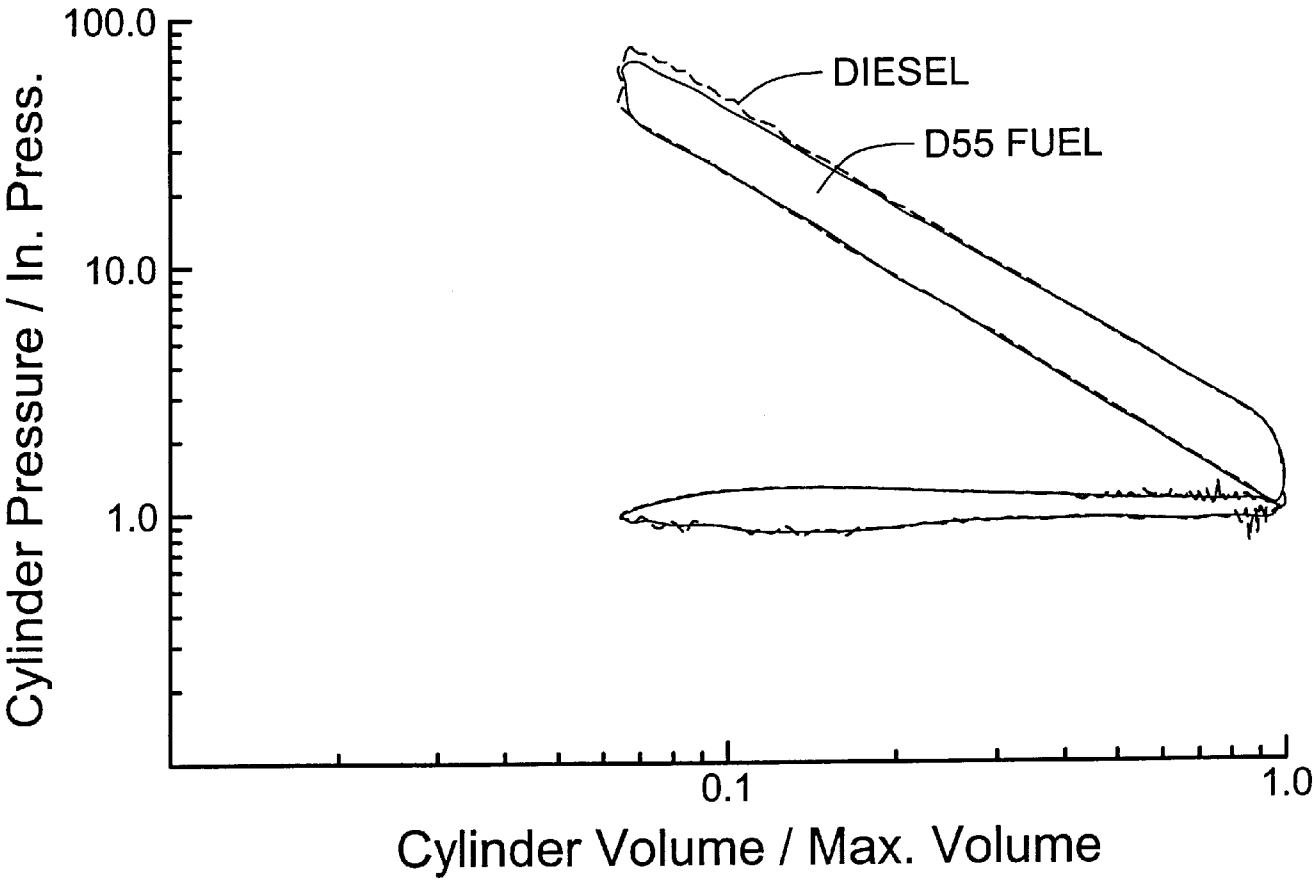
FIG. 1 is a graph showing the relationship between cylinder pressure and volume for traditional diesel fuel and for "D-55"

The novel aqueous fuel of the present invention has less potential energy than the BTU value of carbonaceous fuels, but is nonetheless capable of developing at least as much power. For example, an aqueous fuel of the invention comprising an emulsified mixture of water and gasoline has about one-third the potential energy (BTU's) of gasoline, but when used to operate an internal combustion engine, it will produce approximately as much power as compared with the same amount of gasoline. This is indeed surprising and, though not completely understood and not intending to be bound by theory, is believed to be due to the novel fuel mixture that results from the release of hydrogen and oxygen and the combustion of hydrogen when the novel aqueous fuel is introduced to a combustion chamber of an internal combustion engine and combusted with combustion air in the presence of a hydrogen-producing catalyst by, for example, the method and in the system described in my U.S. Pat. No. 5,156,114. The term "hydrogen-producing catalyst" is used herein in its broadest sense. A catalyst is generally defined as a substance that causes or accelerates activity between two or more forces without itself being affected. In the use of the novel aqueous fuel for combustion in an internal combustion engine, it has been determined that without this substance present in the combustion chamber, combustion of the aqueous fuel does not take place in such a way as to produce the desired degree or power to operate an internal combustion engine. Useful catalysts are disclosed in U.S. Pat. No. 5,156,114.

Again, without intending to be bound by theory, it is believed that upon ignition such as by generation of an electric spark or compression in a combustion chamber with and the presence of poles formed of hydrogen-producing catalyst, dissociation of water molecules appears to occur, resulting from combustion of the carbonaceous material component of the aqueous fuel during the compression stroke which, along with the combustion of released hydrogen, provides the power to operate the engine.

In spark ignited engines, the normal spark of a standard motor vehicle sparkplug system generating about 25,000 to 28,000 volts may be used to ignite the fuel in the combustion chamber, however it is advantageous to generate a hotter spark, e.g., a spark such as is generated by about 35,000 volts. Electric spark generating systems are available in the market with up to 90,000 volts, and it appears that higher voltages result in better dissociation of water molecules in the combustion chamber.

Although useful fuel for the above-described purpose is disclosed in U.S. Pat. No. 5,156,114, the present invention is the result of efforts to further optimize the aqueous fuel for combustion in the combustion chamber of an internal combustion engine equipped with hydrogen-producing catalysts. Fuel according to the present invention is stable, storable, and substantially nonflammable outside the engine. Tests conducted by applying a blowtorch to the fuel have demonstrated the substantial nonflammability of the new fuel, which results from the fuel itself and the formation of the fuel in a manner which creates an emulsion having water as the external continuous phase. Although a brief initial flash may be experienced when the alcohol component present in amounts of about 5% or more is ignited, the fuel then becomes self-extinguishing and nonflammable. The flash point becomes much higher than the flash point of the hydrocarbon, i.e., carbonaceous fuel, in the new fuel. For example, the flash point of gasoline and diesel is about 110° F. and 120° F., respectively, and after the alcohol flashes off, the flash points of the gasoline-containing and diesel-containing fuels are about 280° F. and about 300° F., respectively.

It is presently believed that the reason the aqueous fuel of the present invention can produce satisfactory internal combustion engine results is that in practicing the invention, hydrogen and oxygen are believed to be released in the combustion chamber, as aforesaid. The hydrogen and oxygen result from dissociation of water molecules and the hydrogen is combusted along with the carbonaceous fuel of the aqueous mixture. The result is that comparable engine power output is achieved with less carbonaceous fuel and less combustion air than can be achieved using conventional combustion of the same carbonaceous fuel with greater amounts of combustion air.

It is further noted that with the aqueous fuel of the present invention, the water component vaporizes as steam in the combustion chamber. Steam expands to a greater extent than air and the combustion chamber can be suitably filled with less combustion air. Thus, by transforming to steam the water component of the fuel expands in the combustion chamber and replaces a portion of the combustion air used in combusting conventional fuels in the engine's combustion chamber. The expansion of the steam together with the combustion of the carbonaceous fuel and the hydrogen released by dissociation of the water molecules results in generation of the required power output necessary for satisfactory operation of the engine.

It is also noted that since hydrogen and oxygen are present in the fuel mixture to be combusted in the combustion chamber of an internal combustion engine in accordance with the invention, circumstances may arise in which too little water in the aqueous fuel would be unsatisfactory. For example, where the carbonaceous fuel has a low inherent energy output, i.e. low potential energy of BTU output per unit volume, greater amounts of water may be desirable because the release of hydrogen and oxygen by dissociation of water molecules and combustion of the hydrogen will usefully increase the total energy output of the carbonaceous fuel and water mixture. For this reason, a lower limit of 20% is established as the useful, practical, minimum amount of water in the aqueous fuel mixture of the present invention so as to accommodate a greater variety of carbonaceous fuels within the scope of the invention. The upper limit of 80% water is established because a minimum amount of gaseous or liquid carbonaceous fuel is needed to initiate the reaction. Triggered by a spark generated in the combustion chamber or by compression, the water molecules are discussed in the combustion chamber. It has been determined that from 30,000 to 60,000 BTU energy/gallon of fuel is preferred for the water dissociation reaction.

In a preferred embodiment, the aqueous fuel of the present invention comprises water from about 40% to about 60% by volume of the total volume of the aqueous fuel and, preferably, a volatile liquid carbonaceous fuel, such as a fuel selected from the group consisting of gasoline, straight run gasoline, diesel fuel, kerosene-type fuel, carbon bearing synthetic fuels, biomass derived oils, or mixtures thereof. Alcohol is added to lower the freezing point of the fuel and improve resistance of the fuel to separation into its components. A small but effective amount of a nonionic emulsifier is also necessary. It has been discovered that the emulsifier should be nonionic, as opposed to ionic, because the latter is unsatisfactory with hard water and also leads to buildup of deposits in engines. Nonionic emulsifiers are grouped in three categories: alkylethoxalates, linear alcohol ethoxylates (such as used in laundry detergents) and alkylglucosides. The presently preferred emulsifier is "Igepal CO-630" (an alkylphenoxypolyalcohol, specifically, nonylphenoxpoly (ethylenoxy ethanol) available from Rhone-Paulenc, Inc., Princeton, N.J. Carbonaceous fuel lubricity enhancers are well known and the presently preferred enhancers are silicon-containing compounds such as polyorganosiloxanes, e.g., "Rhodorsil Antifoam 416" available from Rhone-Paulenc, which also exhibit anti-foaming capability. An amount up to about 0.03 vol. % preferably 0.001 to 0.03%, of a fuel lubricity enhancer, as described, has proven to be effective. It may also be desirable at times to include an additive to improve resistance to phase separation at elevated temperatures. For this purpose up to about 0.1 vol. % preferably 0.001 to 0.1%, of an additive for this purpose, such as dihydroxyethyl tallow glycinate, e.g., "Miratain," available from Rhone-Paulenc may be used.

The emulsifier is important to assist in rendering the fuel stable and storable. It also has been determined that the order of adding and mixing the fuel components is critical to achieving stability and storability. For example, it is important to add the emulsifier to the carbonaceous fuel component prior to adding water. It is also important to separately add the alcohol to the water prior to mixing with the fuel. In addition, the amount of water and carbonaceous fuel component is adjusted so that water is the external continuous phase of the emulsion. The particle size and shape of the water can be adjusted by modification of emulsifier's characteristics which also enables adjustment of the viscosity.

A surprising advantage of the fuel composition is that internal combustion engines using the fuel are capable of cold starting even at temperatures as low as −40° F. Visual inspection of cylinder walls, pistons, catalysts and sparkplug indicates no apparent carbon buildup, oxidation or pitting. Internal combustion engines have been operated with the fuel at up to 4,000 RPM without any decline in performance. Another advantage of the fuel is dramatically increased mileage over that obtained per gallon of conventional carbonaceous fuel such as diesel or gasoline, under comparable conditions of use. The fuel is nonflammable and vehicles utilizing the fuel exhibit equivalent drivability to vehicles using traditional carbonaceous fuels. Emissions may be reduced to one-tenth or less of the emissions resulting from traditional fuel usage and the $CO_2$ emissions may be reduced by roughly half. Vapor emissions of the new fuel have been observed to be about half of vapor emissions of corresponding traditional fuels. The new fuel does not result in any carbon buildup in the engine, but rather is responsible for longer engine component life. Very importantly, the fuel is substantially nonflammable outside the engine and therefore represents a great safety improvement over conventional carbonaceous fuels that ignite readily. It has also been determined that the fuel is noncorrosive to rubber and ferrous metals, and therefore may be used with conventional tubing and materials in motor vehicles. This combination of characteristics makes the fuel advantageous to use in all motor vehicles, including trucks, earth-moving equipment and aircraft.

Still another advantage of the invention is that low cost and otherwise less desirable carbonaceous fuels may be used. For example, minimum octane levels in the upper 80's and Reid Vapor Pressure ("RVP") values of 9 or higher typically required in traditional gasolines. In contrast, fuels with octane ratings less than 75 and RVP as low as 6 or less, as well as straight run gasolines may be used in accordance with the invention. Such carbonaceous fuels would not be useful in conventional internal combustion engines.

In order to enhance lubricity of the fuel, it is desirable to incorporate an enhancer, preferably a combustion lubricating enhancer and anti-foaming agent. It has been determined that a silicon-containing compound not only enhances fuel lubricity but reduces foaming of the fuel, it appears to enhance the fuel's combustibility in a combustion chamber. It is useful to use agents that are both enhancers and anti-foaming agents, to avoid the need to include separate materials for these functions.

The aqueous fuel of the present invention is believed to be usable in all internal combustion engines, including conventional gasoline or diesel-powered internal combustion engines for use in automobiles, trucks and the like, using conventional carburetors or fuel injection systems as well as rotary engines and turbine (jet) engines. The invention is also believed to be usable in any engine in which volatile liquid or gaseous carbonaceous fuel is combusted with oxygen ($O_2$) in one or more combustion chambers of the engine.

Few modifications are necessary to make such engines usable with the fuel of the present invention. For example, as disclosed in U.S. Pat. No. 5,156,114, to use the aqueous fuel it is important to install a hydrogen-producing catalyst in the combustion chamber or chambers of the engine, such as described in the aforementioned patent, to act as a catalyst in the dissociation of water molecules to yield hydrogen and oxygen. In addition, any suitable means to supply and control the input, quantity and flow of combustion air and fuel to the combustion chamber(s) may be used for desirable optimum engine operation. It is noted in this regard that the air-to-fuel ratio is a significant factor in effecting combustion in the chamber(s). It is also desirable, from a practical point of view, to make the fuel supply and fuel storage systems of rustproof materials. A higher-voltage electric spark system than generally used in spark ignited internal combustion engines of motor vehicles operated with conventional carbonaceous fuels, e.g., gasoline, is also preferred. Systems to provide a "hotter spark" are available commercially, such as from Chrysler Motor Company. As a further modification to optimize use of the invention, it is desirable to employ a computer-assisted electronically controlled system to supply fuel to fuel injectors or other fuel delivery systems during the intake stroke of the internal combustion engine.

The dissociation of water molecules, per se, is well known. For example, the thermodynamics and physical chemistry of water/steam dissociation are described in the text entitled *Chemistry of Dissociated Water Vapor and Related Systems*, by M. Vinugopalan and R. A. Jones (1968), published by John Wiley & Sons, Inc.; *Physical Chemistry for Colleges*, by E. B. Mellard (1941), pages 340–344, published by McGraw-Hill Book Company, Inc., and *Advanced Inorganic Chemistry*, by F. Albert Cotton and Geoffrey Wilkinson (1980), pp 215–228, the disclosures of which are expressly incorporated herein by reference.

As an example, aqueous fuel and combustion air may be introduced into the carburetor or fuel injection system at ambient temperatures and the air/fuel mixture then introduced into the combustion chamber or chambers where a spark from a sparkplug ignites the air/fuel mixture in the conventional manner when the piston of the combustion chamber reaches the combustion stage of the combustion cycle. The presence of a hydrogen-producing catalyst in the combustion chamber is believed to act as a catalyst for the dissociation of water molecules in the aqueous fuel when the sparkplug ignites the air/fuel mixture. The hydrogen and oxygen released by dissociation are also ignited during combustion to increase the amount of energy delivered by the fuel.

As an illustration of one embodiment of fuel preparation, the following mixing method may be employed:

1. Introduce the desired volume of carbonaceous fuel, e.g. diesel oil or gasoline into a container.

2. Combine a measured amount of emulsifier in a separate container with some diesel fuel or gasoline to obtain a ratio of fuel to emulsifier of approximately 1:1.

3. Mix the emulsifier and fuel until the color is consistent. Mixing reduces the specific gravity of the emulsifier mixture and this procedure prevents the emulsifier from sinking to the bottom of the container after it is added to the remaining diesel or gasoline.

4. Add the emulsifier and diesel or gasoline mixture to the remaining carbonaceous fuel to be formulated and stir.

5. In a separate container add alcohol and the desired volume of water. It is preferred to mix, e.g., stir the alcohol-and-water mixture, e.g., for about 15 to 30 seconds.

6. Combine the water-alcohol mixture and the fuel-emulsifier mixture and stir until it turns a uniform color.

7. Agitate the entire mixture vigorously such as in a hydroshear or a shear pump, a suitable setting being between 210 and 280 psi. The output from the hydroshear or shear pump then becomes a consistently colored, e.g., milky white, fuel formulation.

The following example illustrates the effect of emulsifier on the fuel formulation. Test batches were prepared as follows: all mixtures consisted of 8 parts diesel oil and 6 parts water, but emulsifier concentrations varied between 0.2 and 0.7% by volume in 0.1% increments. Samples of each test batch were taken after each of three passes through the hydroshear.

It was determined that emulsifier concentrations below 0.5% tended to be unstable, whereas emulsifier concentrations of 0.5% and 0.7% were each equally stable.

Tests of fuel mixtures with varying alcohol contents have established the stability of the formulation is good with at least 2% alcohol. At the upper end, the fuel mixtures with 20% alcohol displayed significant separation of the diesel oil rather than separation of the water.

Freezing-point observations indicated a dramatic lowering of the freezing point as the percentage of alcohol is increased, which is to be expected, but also that varying the percentage of water in the mixture has little effect on the freezing point.

In specific tests, fuel with 0% alcohol separated completely. The samples in the preferred range of 2 to 10% alcohol never separated upon thawing. With at least 2% alcohol there will be no phase separation for extended periods, e.g., 6 months.

Horsepower testing was also conducted and it was found that a rapid decrease in horsepower occurs after certain increases in percentage of water. Also, the horsepower gradually decreases as the alcohol is increased.

Conventional thought would predict that these changes in horsepower would be due to changes in the heat content (BTU/gallon or BTU/lb) of the fuel. However, this does not appear to be the case. Analysis of the heat content contribution from each constituent of the fuel does not resolve these anomalies.

The following are typical characteristics for the nominal gasoline and diesel fuel formulations disclosed above, as compared to standard gasoline and diesel fuels, "A-55" referring to the gasoline-fuel mixture and "D-55" referring to the diesel-fuel mixture. After these tables, an additional table is provided comparing Naptha and a naptha-water emulsion.

| A-55* | GASOLINE |
|---|---|
| Reid vapor pressure<br>5.48 | Reid vapor pressure (psi)**<br>Volatility Class A - 9<br>Volatility Class E - 15 |
| Distillation Temperatures (° F.) at Percent Evaporated | Distillation Temperatures (° F.) at Percent Evaporated |
| 10% | 10% |
| Test (6/92) - 146<br>Test (2/93) - 133 | Volatility Class A (max) - 158<br>Volatility Class E (max) - 122 |
| 90% | 90% |
| Test (6/92) - 210<br>Test (2/93) - 212 | Volatility Class A (max) - 374<br>Volatility Class E (max) - 230 |
| End Point | End Point |

-continued

| A-55* | GASOLINE |
|---|---|
| Test (6/92) - 260<br>Test (2/93) - 220 | Volatility Class A (max) - 437<br>Volatility Class E (max) - 437 |
| Gravity, API @ 60° F. | |
| Test (6/92) - 33.2<br>Test (2/93) - 33.8 | Specific Gravity @ 60° F.***<br>.713–.739 |
| BTU/lb (gross) | |
| Test (6/92) - 10,499<br>Test (2/93) - 9,772 | BTU/lb (HHV)***<br>20,260 |
| BTU/lb (net) | |
| Test (6/92) - 9,450<br>Test (2/93) - 8,677 | BTU/lb (HHV)***<br>18,900 |

*The difference between the 6/92 test and the 2/93 test can be due in large part to the use of a nonoxygenated, lower-grade base gasoline in the 2/93 test along with the addition of additive as described in the "Typical Measurements and Mixing Procedures" table in the "Characteristics Comparison" section of the application which protect the fuel from frost during winter conditions.
**Comparative information from Annual Book of ASTM Standards (1991).
***Comparative information from Marks' Standard Handbook for Mechanical Engineers, Edition VIII, McGraw-Hill Inc. (New York 1978), pp.7-14 through 7-16.

| D-55<br>(No. 2 diesel as base fuel) | DIESEL<br>(No. 2 diesel alone for comparison) |
|---|---|
| Gravity, API at 60° F.*<br>25.5 | Gravity, API at 60° F.*<br>26–34 |
| Flash Point (° F.)<br>166 | Flash Point (° F.)*<br>125 (min.) |
| BTU/lb (gross)<br>12,341 | BTU/lb (HHV)**<br>(using 30 gravity, API at 60° F. as average)<br>19,420 |
| BTU/lb (net)<br>11,246 | BTU/lb (LHV)**<br>(using 30 gravity, API at 60° F. as average)<br>18,250 |

*Comparative information from Karl W. Stinson, Diesel Engineering Handbook, XII Edition, Diesel Publications, Inc. (Stamford 1980), p. 33.
**Comparative information from Karl W. Stinson, Diesel Engineering Handbook, XII Edition, Diesel Publications, Inc. (Stamford 1980), p. 38.

| Naptha and Water<br>(40% Naphtha) | Naptha |
|---|---|
| Reid vapor pressure, psi - 10.80 | Reid vapor pressure, psi - 13.97 |
| Lead content, gm/gal - <0.001 | Lead content, gm/gal - <0.001 |
| Sulfur, x-ray, ppm - 0.02 | Sulfur, x-ray, ppm - 0.028 |
| Gravity, api @ 60 deg. F. - 40.1 | Gravity, api @ 60 deg. F. - 82.0 |
| Gum unwashed, mg/100 ml - 122 | Gum unwashed, mg/100 ml - 0.6 |
| Gum washed, mg/100 ml - 293 | Gum washed, mg/100 ml - 0.03 |
| Oxidation stability, minutes - +240 | Oxidation stability, minutes - +240 |
| Aromatics, vol pct - 4.2 | Aromatics, vol pct - 2.7 |
| Olefins, vol pct - 0.0 | Olefins, vol pct - 0.0 |
| Saturates, vol pct - 95.8 | Saturates, vol pct - 97.3 |
| Btu/lb (gross) - 8.080 | Distillation, % recovered, deg. F., ibp - 88 |

Mixing of the A-55 and D-55 Fuels

As mentioned previously, properly mixing either the A-55 or D-55 fuel is important for the ultimate performance of the fuel. Improper mixing can cause separation of the gasoline and water components, thereby causing uneven running conditions in the engine which increase emissions and decrease performance. Separation of the fuel can also reduce the fire safety of the fuel which is discussed below.

The first stage of proper mixing is to assure the order in which the components are put together. The stirring or mixing which may be used in this stage can be relatively light, for example hand-mixing will be sufficient when preparing small batches of either A-55 or D-55 fuels. A pre-measured amount of emulsion is added to the pre-measured amount of gasoline or diesel fuel. Adding the emulsion to the water first will cause gelling of the emulsion which greatly hinders the proper mixing process. After the emulsion is added to the gasoline or diesel, it should be lightly stirred so that the emulsion comes into contact with the greatest surface area of gasoline or diesel. A pre-measured amount of water is then usefully stirred into the gasoline or diesel and emulsion mixture. As the water is added to the gasoline or diesel emulsion mixture, the mixture will turn opaque and off-white in color when lightly stirred.

When adding alcohol, e.g., methanol, to prevent the fuel from freezing, a pre-measured amount of methanol is usefully mixed with the water before the water is added to the gasoline or diesel and emulsion mixture. When adding lubricating enhancer and anti-foam to prevent foaming in some fuel delivery systems, the agent should be added after all other components have been mixed together in this first stage for proper mixing.

Following is an example of the mixing procedure for preparation of a 14.06 liter batch of A-55 fuel:

1. Starting with 8 liters of gasoline,
2. Add 60 milliliters of emulsifier to the gasoline and stir lightly,
3. Add 300 milliliters of methanol to 6 liters of deionized and charcoal-filtered water,
4. Add the water and methanol mixture to the gasoline and emulsifier mixture and stir until the entire mixture becomes opaque and off-white in color, and then
5. Add 5 drops of anti-foam/lubricity enhancer and stir lightly.

The components, combined in this manner, are then ready for stage two of the mixing process. Stage two involves circulating the fuel through a pump so that the components mix properly. The larger the pump, that is to say the larger the shear pressure in the pump, the better mixed the fuel becomes and remains. For example, if fuel is only mixed through a relatively small pump such as a fuel pump of the size used for standard automobile fuel pumps, some separation will be experienced within three weeks. On the other hand, a pump with approximately 100 times the volume flow will keep the fuel mixed without separation for over three months at a time. Experiments have shown that the fuel mixed through small pumps, no matter how many times the fuel is circulated, will separate within weeks. Fuel mixed using a larger pump stays together for over three months without detectable separation.

When properly mixed, the fuel generally displays four characteristics: (1) a consistent color, usually milky white; (2) recurring hydrometer and specific gravity readings which are different from straight gasoline or diesel, as shown below; (3) the fuel will have no visible separation, either in the form of a layer of gasoline or diesel on surface of the fuel mixture or spots of gasoline or diesel on the surface of the fuel mixture; and (4) the fuel, when properly mixed, will not burn under a torch, as described below, after an initial flash or burn off of the alcohol.

| Proof Readings on a Hydrometer for Each Fuel at 60° F.* | |
|---|---|
| A-55 - 165 proof reading | straight 87 octane gasoline - over 200 proof reading |
| D-55 - 130 proof reading | straight no. 2 diesel - 161 proof reading |
| **Specific Gravity for Each Fuel at 60° F.**** | |
| A-55 - 0.84 | straight 87 octane gasoline - 0.72 |
| D-55 - 0.89–0.91 | straight no. 2 diesel - 0.84 |

*As measured on a Proof and Tralle scaled hydrometer
**As measured on an Ohaus 1500D electronic scale

Use of Additives in Either A-55 or D-55 for Specific Conditions

The described fuels have been shown to be usable in cold weather to −65° F. as well as in hot weather up to 130° F. These coincide with driving cycles and stationary power generation for average and extreme conditions found in the global environment. As described earlier, the addition of alcohol to the water will prevent freezing in most temperature ranges. For example, adding 300 milliliters of methanol to the water in the fuels described above prevents freezing of the fuel to well below 0° F. The fuel, as described and mixed, can withstand temperatures to 130° F. without separation. Both A-55 and D-55 fuels may display signs of separation at higher temperatures; however, the fuel can be mixed to include more emulsifier, which will prevent separation to 170° F. At temperatures higher than 170° F., a more powerful pump and recirculation system should be used to keep the fuel from separating too quickly. For best results, a suitable additive may be included, as previously described to resist phase separation or elevated temperature.

When mixing the fuel, the creation of large amounts of foam should be avoided. Foam in the fuel can distort performance and emission results. The addition of small amounts of an anti-foaming agent may be used to avoid the problem.

Fire Safety of the A-55 and D-55 Fuels

Both A-55 and D-55 fuels are water-phased, which makes these fuels fire-safe. To demonstrate that the fuel is water-phased, the following test was performed: approximately 200 milliliters of deionized and charcoal-filtered tap water was placed in one container and approximately 200 milliliters of straight gasoline in another. With a syringe, one drop of A-55 fuel was placed in each container. As the drop of A-55 fuel hits the surface of the water in the first container, the drop of A-55 fuel instantly dissipates on the surface, leaving a slightly cloudy residue on top of the container. The drop of A-55 fuel placed into the container with gasoline reacts differently. In this case, the drop of A-55 fuel stays together upon hitting the surface of the gasoline and sinks to the bottom of the container. The drop continues to remain together long after having been introduced to this gasoline. The external water phase of the D-55 fuel may be also demonstrated by this test. The same results are obtained using the D-55 fuel and a container of deionized and charcoal-filtered water and a container of straight diesel fuel.

When properly mixed, neither fuel can be ignited with a blowtorch. As an example, 60 ml of A-55 and D-55 fuel were poured onto a metal slab in small puddles. A flame of a blowtorch was then passed over the fuels with the tip of the flame touching the top surfaces of the fuels. The fuels did not ignite. occasionally, and only after the flame was left directly on the fuels in one place for approximately 20 seconds, a lazy blue flame approximately ¼ inch in height appeared momentarily and then extinguished itself. If the carbon fuel, gasoline and emulsion are not mixed properly, the mixture will ignite very easily.

Benefits of Low Vapor Pressure of A-55 and D-55 Fuels

Another factor making the fuel hard to ignite is the extremely low vapor pressure of the fuels. Moreover, the fuels with lower vapor pressure result is reduced vapor emissions, thereby significantly reducing the need for vapor recovery systems on gasoline pumps or vapor recovery systems on automobiles and stationary engines. A lower Reid vapor pressure also reduces harmful emissions into the environment.

Octane and Cetane Rating

High-octane gasoline is generally recommended for use in current auto and truck engines. Usually, the lowest octane gasoline which can be obtained at a service station is 87 octane. High-octane gasoline registers 92 or higher. The A-55 fuel operates effectively even with extremely low-octane, naphtha-based gasoline which registers approximately 75 octane because octane does not seem to play a role with this fuel. The cetane rating in the D-55 fuel is also considerably lower than in traditional diesel fuels without adverse effect on performance. Because of this, the new fuels should be cheaper to produce than traditional gasoline or diesel, not just because of the water component, but also inasmuch as the base gasoline or diesel does not require extensive and expensive refining.

Fuel Filters

Customary fuel filters used for internal combustion engines have a paper core system for filtration. A-55 or D-55 can be used with these filters; however, after a relatively short running time, these filters may act like a reverse osmosis system and may cause separation of the fuel before use in the injectors. To avoid the separation effect with paper filters, it is preferred that in lieu of paper filters the fuels flow through either a free-flow filter which catches only relatively large particles or through a metal mesh filter. Fuels can be filtered down to 10 microns with these metal mesh filters without changing any of the fuel characteristic before the injectors. Plastic or metal plate filters have also been tested with very positive results.

Power Comparison of A-55 and D-55 Fuels to Gasoline and Diesel, Respectively In comparison testing, the A-55 fuel has been compared with high-octane gasoline on the same engine using an engine dynamometer. The A-55 fuel has approximately the same power output plus or minus 4% than running the same engine on gasoline, using the same amount of combustion air was for both fuels at the higher power requirements. The engine used during this test was modified substantially in accordance with description in U.S. Pat. No. 5,156,114. The power results of the modified engine running on gasoline where not significantly different from the results of similar engines running on gasoline tested in the same fashion. Similar results are obtained with D-55. Top power output can also be achieved using the D-55 fuel three to five times faster than by using ordinary diesel fuel. Varying the amount of water percentage in the A-55 and D-55 fuel, up to plus or minus 10%, does not cause a respective gain or loss of horsepower.

Timing Requirements

For optimum results when A-55 fuel is used, the ignition angle should be advanced to 50°, which is approximately double that required for traditional gasoline fuel. The D-55 fuel also works best when the injector timing is advanced at the injectors and on the crankshaft by up to two teeth.

Air-to-Fuel Ratios Using A-55 or D-55 Fuels

In the idle position, A-55 or D-55 can be used with minimal combustion air ratios.

When A-55 or D-55 fuels are used under power conditions, substantially the same amount of combustion air is used as with traditional gasoline or diesel fuel. The air-to-fuel ratio in normal internal combustion engines with spark ignition is 14.7:1. The diesel cycle is 16.5:1. If those ratios are increased by more than 10%, combustion in internal combustion is lost. Using A-55 fuel, the air-to-fuel ratios under power requirements measured to the carbon component of the fuel are approximately 29–38 air to 1 carbon component in an internal combustion engine with spark ignition. Using D-55 fuel , the air-to-fuel ratios under power requirements measured to the carbon component of the fuel are approximately 32–40 air to 1 carbon component in a diesel engine.

Emissions Using A-55 or D-55 Fuel in Modified Engines

Many emission comparisons between A-55 fuel and straight high-octane gasoline have been conducted with a Clayton chassis dynamometer, model C796, which monitors both speed and power. A comparison of a 1989 6-cylinder Ford Taurus with a 3-liter engine, converted to operate on the A-55 fuel, and a 1989 Ford Taurus with similar odometer readings which operates on traditional gasoline was made. The catalytic converter on both vehicles were removed. It was found that using the A-55 fuel, almost all emission readings are reduced by six to ten times under power conditions. Only the $O_2$ readings are similar on both vehicles. The $O_2$ readings are in the range between 0 and 3% at the best power output. In this range, other emissions register as follows: CO is 0.10% or lower, $NO_x$ is from 20 to 200 parts per million, and hydrocarbons are from 50 to 200 parts per million. All emission readings are taken on a Sun standard automotive emission analyzer. When the engine is at running temperature, there is no visible steam emitted from the tailpipe regardless of the outside temperature. This can be compared to ten times or more ppm NOx from similar engines operated with traditional gasoline as fuel.

Emissions are even more drastically reduced on converted diesel engines. For the following discussed testing purposes, a converted #53 Detroit Diesel 2-cycle, 4-cylinder diesel engine was used on an engine stand. The converted diesel engine was connected to a Clayton engine dynamometer, Model CAM 250E, which reads speed, power and torque. The converted diesel engine during a dead cold start developed only visible smoke for 2 to 5 seconds. Usually, a similar diesel engine with regular diesel fuel there would be visible smoke for 5 to 10 minutes during the warm-up period between dead cold and running temperature. The engine did not produce the customary soot at any power range such as is found in diesels running straight diesel fuel. At approximately 100 hp emission results are as follows: $O_2$—10%, HC—0 parts per million and CO—0.01%. The viscosity is substantially maintained and, as with the gasoline-containing fuel, combustion is clean even after extended use. All emission readings were taken on a Sun standard automotive emission analyzer. At no time during the running cycle of the diesel engine was there any visible steam emitted from the tailpipe regardless of the outside temperature. These results can be compared HC emissions of at least two to three times more on similar engines using regular diesel fuel.

Additional tests have also demonstrated that NOx reduction using D-55 fuel is as much as 80% less than traditional diesel fuel.

Efficiency of the A-55 and D-55 Fuels

The efficiency produced from both fuels for the most part is significantly greater than with traditional gasoline or diesel. Naturally, variations in efficiency may result depending on how the engine is modified and what percentages of carbon fuel to water are used. Tests on efficiency of traditional gasoline or diesel versus the carbon component of the A-55 and D-55 fuels with both fuels on engines modified completely or to some extent as outlined in U.S. Pat. No. 5,156,114 have shown dramatic efficiency gains using these fuels, as much as 100% over running the same or similar engine on traditional carbon fuels.

Cold-Starting of A-55 or D-55 Fuels

Both the A-55 and D-55 fuels can be used as the exclusive fuel in internal combustion engines. There is no need to use secondary fuel or starting fuel in combination with either A-55 or D-55. Neither fuel exhibits any difficulty at cold start when used in modified engines with some or all of the modifications outlined in U.S. Pat. No. 5,156,114.

Comparison of Diesel Engine Usage

Figure 2:
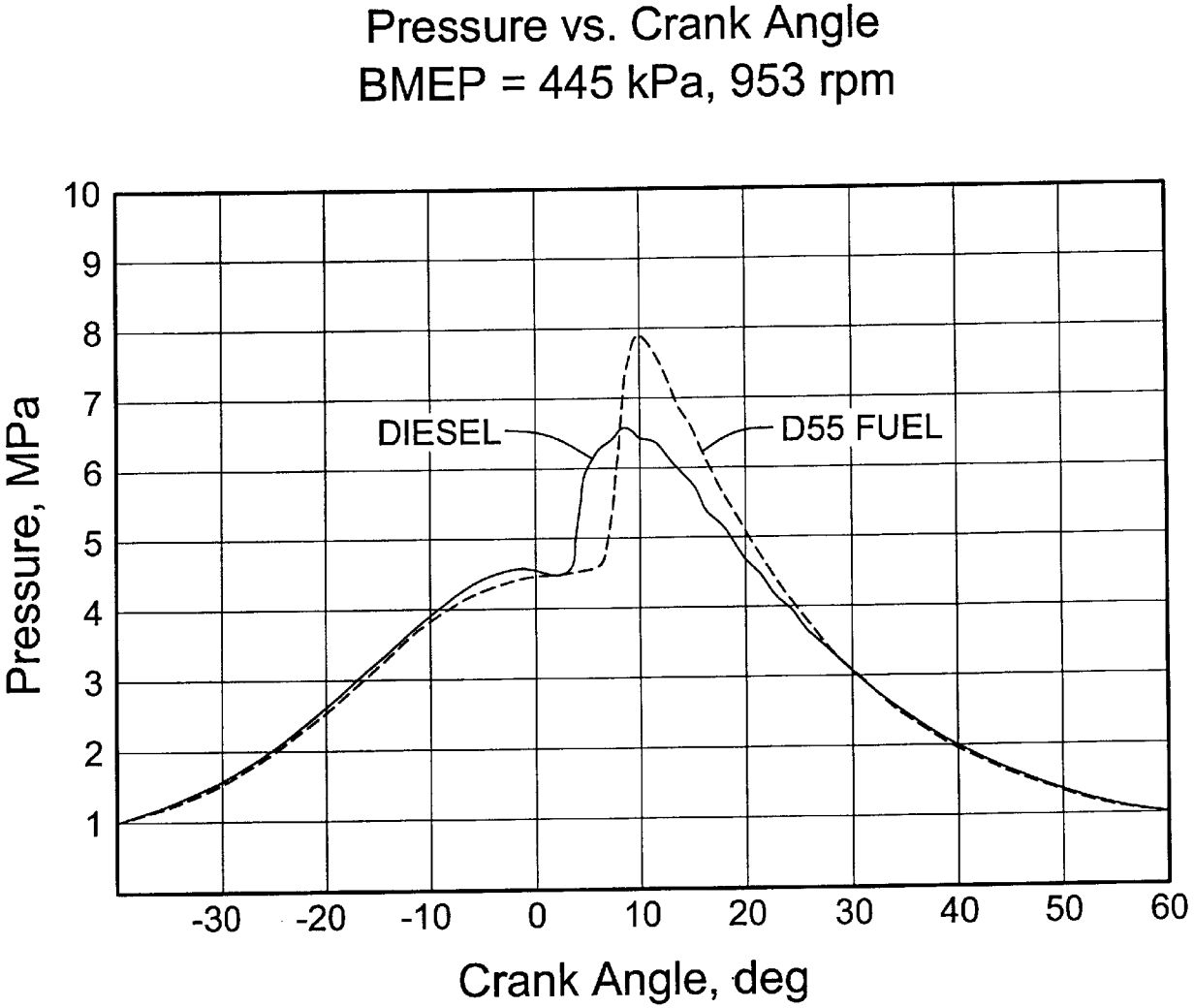
FIG. 2 is a graph showing comparing cylinder pressure and crank angle for diesel fuel and "D-55"
Figure 3:
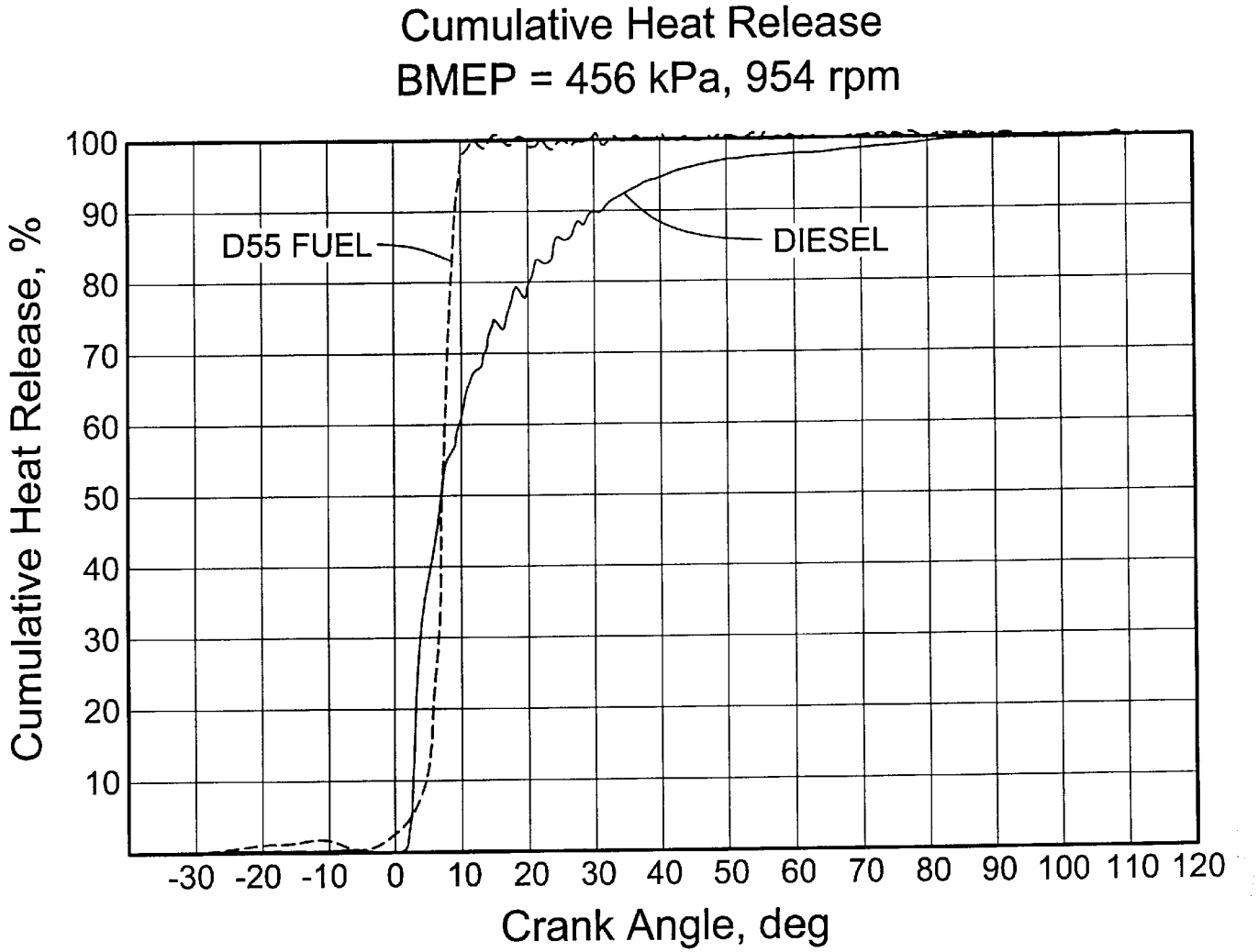
FIG. 3 is a graph showing cumulative heat release of diesel fuel and "D-55" in relation to crank angle.

To further illustrate advantages of the new aqueous fuel in diesel engines, reference is made to the accompanying drawings including the graphs shown in FIGS. 1–3. These graphs report the results of tests performed on D-55 fuel formulations comparing the new fuel with traditional diesel fuel.

In FIG. 1 the relationship between cylinder pressure and volume is described for both the D-55 and the diesel fuel. As can be seen, the cylinder pressure as compared to volume of the new fuel tracks very closely to that of the diesel fuel. Therefore, D-55 is a full substitute for diesel fuel in diesel engines.

The relationship between pressure and crank angle is shown in FIG. 2 which demonstrates that although cylinder pressure exerted by D-55 is increased somewhat as compared to regular diesel fuel, the difference is slight. As the graph shows, D-55 has a higher pressure release but one which is still well within design specifications for existing diesel engines.

The most significant results are shown in FIG. 3 which compares the cumulative heat release, as a percentage, to the crank angle, in degrees, for both D-55 and traditional diesel fuel. It is evident that D-55 is much quicker to achieve and sustain 100% heat release than traditional diesel fuel and thus exhibits substantially improved thermal efficiency. This is evident from the dramatic rise in heat release of the D-55 as opposed to the heat release for traditional diesel fuel. The D-55 reaches 100% heat release after just 10% crank angle as compared to the traditional fuel which reaches 100% around an 800 crank angle. Although D-55 fuel has a slower initial combustion, it has a quicker heat released than the diesel. Furthermore, it is possible to have the heat release closer to the 0 crank angle by adjusting the timing so that the fuel is introduced slightly earlier in the cycle.

It is apparent from a review of the data illustrated in FIGS. 1–3, including the improved heat release of D-55 over traditional diesel fuel, that the new fuel provides a substantially increased gain in power. Using the 0 crank angle as a point of reference, the unexpected results from the new fuel which uses approximately ½ of the amount of diesel is rather startling. Furthermore, the increase in power is obtained without substantial increase in the pressure, as seen in FIG. 2, and thus without damaging the engine. In other words, the power is obtained from substantially the same cylinder pressure but with a fuel which has the BTU value of only about ½ of the hydrocarbon component as compared to the traditional diesel fuel.

It is apparent from the foregoing that various changes and modifications may be made without departing from the invention, wherein was is claimed is:

What is claimed is:

1. A stable, storable fuel combustible in an internal combustion engine but substantially nonflammable outside the engine, said fuel consisting essentially of a two-phased fluid emulsion of gasoline, about 40% to about 60% water, about 2% to 10% alcohol, about 0.3% to about 0.7% nonionic emulsifier, about 0.001% to about 0.1% polyorganosiloxane lubricity enhancer, and from about 0.001% to about 0.1% of an additive to improve resistance to phase separation at temperatures above about 170° F., the resulting emulsion comprising a standard O/W emulsion with water being the external continuous phase.

2. A stable, storable fuel combustible in an internal combustion engine but substantially nonflammable outside the engine, said fuel consisting essentially of a two-phased fluid emulsion of diesel fuel, about 40% to about 60% water, about 2% to less than 20% alcohol, about 0.3% to about 0.7% nonionic emulsifier, about 0.001% to about 0.1% polyorganosiloxane lubricity enhancer, and from about 0.001% to about 0.3% of an additive to improve resistance to phase separation at temperatures above about 170° F., the resulting emulsion comprising a standard O/W emulsion with water being the external continuous phase.

3. A stable, storable fuel combustible in an internal combustion engine but substantially nonflammable outside the engine, said fuel consisting essentially of a two-phased fluid emulsion of straight run gasoline, about 40% to about 60% water, about 2% to about 10% alcohol, about 0.3% to about 0.7% nonionic emulsifier, about 0.001% to about 0.1% polyorganosiloxane lubricity enhancer, and from about 0.001% to about 0.3% of an additive to improve resistance to phase separation at temperatures above about 170° F., the resulting emulsion comprising a standard O/W emulsion with water being the external continuous phase.

4. A method for preparing a stable, storable fuel combustible in an internal combustion engine but substantially nonflammable outside the engine, said fuel comprising an at least two-phased fluid emulsion of 20 to 80 volume % water, a carbonaceous fuel selected from the group consisting of gasoline, straight run gasoline, kerosene fuel, diesel fuel, gaseous carbon-containing fuel, carbon bearing synthetic fuel, biomass derived oils and mixtures thereof, about 2% to less than 20% alcohol and about 0.35 to about 1 volume % of a nonionic emulsifier, said emulsion comprising a standard O/W emulsion with water being the external continuous phase, said method comprising:

a) providing a first mixture of said carbonaceous fuel and said emulsifier, b) combining 20 to 80 volume % water and 2 to less than 20% of said alcohol with said first mixture to form a second mixture, c) incorporating a polyorganosiloxane lubricity enhancer into said second mixture, and d) thoroughly mixing said second mixture, after incorporation of said polyorganosilioxane lubricity enhancer, with sufficient agitation to produce an emulsion which is stable for at least three months.

5. A method for preparing a stable, storable fuel combustible in an internal combustion engine but substantially nonflammable outside the engine, said fuel comprising an at least two-phased fluid emulsion of 20 to 80 volume % water, a carbonaceous fuel selected from the group consisting of gasoline, straight run gasoline, kerosene fuel, diesel fuel, gaseous carbon-containing fuel, carbon bearing synthetic fuel, biomass derived oils and mixtures thereof, about 2% to less than 20% alcohol and about 0.35 to about 1 volume % of a nonionic emulsifier, said emulsion comprising a standard O/W emulsion with water being the external continuous phase, said method comprising:

a) providing a first mixture of said carbonaceous fuel and said emulsifier, b) combining 20 to 80 volume % water and 2 to less than 20% of said alcohol with said first mixture to form a second mixture, c) combining a polyorganosiloxane lubricity enhancer and an additive to resist phase separation at elevated temperatures to form a third mixture and incorporating said third mixture into said second mixture such that said lubricity enhancer comprises from about 0.001% up to 0.1% of said third mixture, and d) thoroughly mixing said third mixture with sufficient agitation to produce an emulsion which is stable for at least three months.

6. A fuel produced according to claim 5.

* * * * *